US008382416B2

(12) United States Patent
Hoffmann et al.

(10) Patent No.: US 8,382,416 B2
(45) Date of Patent: Feb. 26, 2013

(54) GATHERING AND STITCHING MACHINE AND METHOD FOR OPERATING THE GATHERING AND STITCHING MACHINE

(75) Inventors: Steffen Hoffmann, Leipzig (DE); Klaus Schumann, Leipzig (DE); Andreas Steinert, Beucha (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 319 days.

(21) Appl. No.: 12/721,708

(22) Filed: Mar. 11, 2010

(65) Prior Publication Data

US 2010/0232911 A1 Sep. 16, 2010

(30) Foreign Application Priority Data

Mar. 11, 2009 (DE) ..... 10 2009 012 724

(51) Int. Cl.

| | |
|---|---|
| ***B42D 1/00*** | (2006.01) |
| ***B42C 9/00*** | (2006.01) |
| ***B42C 13/00*** | (2006.01) |
| ***B42B 5/00*** | (2006.01) |

(52) U.S. Cl. ..... 412/12; 281/21.1; 412/1; 412/6; 412/9; 412/13; 412/33

(58) Field of Classification Search ..... 281/21.1; 412/1, 6, 9, 12, 13, 33

See application file for complete search history.

(56) References Cited

U.S. PATENT DOCUMENTS

| | | | | |
|---|---|---|---|---|
| 3,718,939 | A * | 3/1973 | Mebus | 412/1 |
| 5,863,372 | A * | 1/1999 | Fabel | 412/6 |
| 7,451,969 | B2 | 11/2008 | Böttcher et al. | |
| 2005/0249575 | A1 * | 11/2005 | Steinert et al. | 412/33 |

FOREIGN PATENT DOCUMENTS

| | | |
|---|---|---|
| DE | 1 216 837 | 5/1966 |
| DE | 1216837 B | 5/1966 |
| DE | 38 28 147 A1 | 2/1990 |

* cited by examiner

*Primary Examiner* — Dana Ross
*Assistant Examiner* — Justin V Lewis
(74) *Attorney, Agent, or Firm* — Laurence A. Greenberg; Werner H. Stemer; Ralph E. Locher

(57) ABSTRACT

A method collates multiple-layer brochures containing a plurality of n signatures having a gathering and stitching machine. Here, in a first step, the depositing of a first signature takes place by a first feeder into a first transport segment and, in a second step, the depositing of a second signature takes place by a second feeder into a second transport segment. Correspondingly further depositing of further signatures can take place by further feeders into further transport segments. Finally, depositing of an n-th signature takes place by an n-th feeder into an n-th transport segment. The signatures which are deposited on a gathering element in this way are transported through the stitching station and the trimming station and are delivered in the delivery station. A gathering and stitching machine performs the method and has a control unit which has a machine program for collating multiple-layer brochures having a plurality of n signatures.

10 Claims, 2 Drawing Sheets

GATHERING AND STITCHING MACHINE AND METHOD FOR OPERATING THE GATHERING AND STITCHING MACHINE

CROSS-REFERENCE TO RELATED APPLICATION

This application claims the priority, under 35 U.S.C. §119, of German application DE 10 2009 012 724.0, filed Mar. 11, 2009; the prior application is herewith incorporated by reference in its entirety.

BACKGROUND OF THE INVENTION

Field of the Invention

The invention relates to a method for collating multiple-layer brochures via a gathering and stitching machine containing a gathering section having a gathering element and a plurality of feeders which are disposed along the gathering element for depositing signatures onto the gathering element. The machine further has a stitching station, a trimming station and a delivery station. The gathering section, the stitching station, the trimming station and the delivery station are connected to a common control unit, and the gathering element has a plurality of transport segments.

According to the prior art, books are produced in book production lines. A book production line, as described, for example, in published, non-prosecuted German patent application DE 38 28 147 A1, contains a multiplicity of machines which are arranged behind one another and optionally are linked to one another via a book conveying device. The machines includes machines for collating book blocks, machines for book binding which includes roughening the book spine, gluing the spine and attaching a cover, and machines for drying and/or cooling, for pressing down, for trimming the sides, optionally for fitting book covers and for stacking the finished books.

Collating machines serve to collate book blocks from a multiplicity of folded sheets and contain two essential elements: a device for transporting the gathered sheets, what is known as a block gatherer, and a plurality of feeders. The block gatherer can have, for example, a gathering channel with drivers which push the gathered sheets. As an alternative, the block gatherer can have transporting compartments which circulate on a conveying device. The feeders can be configured as feeders with gripper tongs or feeders with a gripper drum.

German patent DE 1 216 837 discloses a collating machine of this type having feeders with gripper tongs arranged in a row next to one another and with an endless conveying device which is provided with drivers. The collating machine has both a book block delivery device and a transfer device for transferring the book blocks to a following machine for further processing, such as a perfect binder.

In small firms for further processing and book binders and for relatively small runs, the book blocks are frequently collated manually, however. The reason for this is the high costs for a collating machine in terms of purchasing and maintaining. Relatively small firms for further processing also frequently have only relatively small perfect binders which are loaded manually. Collating by hand makes it possible for these companies to accept the orders for small runs of this type. Here, the personnel expenditure is correspondingly great and there is a high susceptibility to errors. It can happen easily in the case of thin materials that a signature is missed out or a signature is picked up twice during collating.

SUMMARY OF THE INVENTION

It is accordingly an object of the invention to provide a gathering and stitching machine and a method for operating the gathering and stitching machine which overcome the above-mentioned disadvantages of the prior art methods and devices of this general type, which provides a simple, efficient and inexpensive solution for collating.

The object is achieved by a method for collating using a gathering and stitching machine.

Gathering and stitching machines are known and described, for example, in German utility model DE 20 2008 002 441 U1. Individual folded sheets are separated from a stack by folded sheet feeders, opened and deposited onto the gathering chain. The gathering chain has a guide device, the upper section of which is of blade-shaped configuration and the ridge line of which fixes the transporting and stitching line, and a substantially roof-shaped support, astride which the folded sheets are transported. In order to reliably grip the folded sheets which are deposited onto the gathering chain even at a high processing speed, in order to achieve a reliable driving connection and in order to transport the folded sheets uniformly, the gathering chain has driver elements which convey the deposited folded sheets in the horizontal direction. The folded sheets which are conveyed by the gathering chain and the drivers are transported by the gathering chain as far as a stitching station. In the case of the regular use of a gathering and stitching machine, folded sheets which lie on one another are stitched in the fold with the aid of wire staples in the stitching station. Stitching heads which are arranged above the gathering chain and clincher boxes which are arranged below the gathering chain and bend over the free ends of the wire staples which are pierced through the folded sheets by the stitching heads serve for this purpose. Afterward, the stitched folded sheets are conveyed further in the delivery range by the gathering chain for further processing. This is followed, for example, by edge trimming in a trimmer or three side cutter and subsequently by the delivery of the finished brochures.

The method according to the invention for collating multiple-layer brochures, containing a plurality of n signatures, takes place with the use of the gathering and stitching machine. The gathering and stitching machine has a gathering section which has a gathering element which is moved by a drive and a plurality of m feeders which are arranged along the gathering section for depositing signatures onto the gathering element. The gathering element can be, in particular, a gathering chain. The gathering element has a plurality of transport segments. In the case of a gathering chain, these are formed by the drivers. Furthermore, the gathering and stitching machine has a stitching station, a trimming station and a delivery station. The drive of the gathering element and the delivery station are connected to a common control unit. It is advantageous if the stitching station and the trimming station are also connected to the control unit. Here, the collation of multiple-layer brochures takes place as described in the following text: in a first step, a first signature is deposited by a first feeder into a first transport segment of the gathering element. In a second step, a second signature is deposited by a second feeder into a second transport segment. To this end, the gathering element is moved further by its drive in such a way that the second transport segment is situated below the second feeder at this instant. In the following text, correspondingly further depositing of further signatures takes place by further feeders into further transport segments. The last signature of the multiple-layer brochure, called the n-th signature here, is deposited by an n-th feeder into an n-th transport segment. In other words: transport segments of the gathering element which follow one another then contain signatures which follow one another and are to be collated in this sequence to form a multiple-layer brochure, that is to say to form a book block. Subsequently, the signatures are transported through the stitching station and the trimming station without being stitched or trimmed, and finally are deposited in the delivery station.

This method according to the invention makes it advantageously possible to collate individual signatures by the gathering and stitching machine to form a book block. This can replace the manual collation in a simple way. For firms for further processing and small book binders which already have the gathering and stitching machine but no collation machine, this method makes inexpensive and rapid collation of book blocks for small runs possible, which can be bound subsequently in a small perfect binder which is fed by hand.

In one advantageous development of the method described in the preceding text, the delivery of the multiple-layer brochures takes place in such a way that a respective multiple-layer brochure is delivered separately from a subsequently collated multiple-layer brochure. This takes place in an advantageous way such that the signatures which form a multiple-layer brochure are delivered in one stack and the signatures which form a subsequently collated multiple-layer brochure are delivered with an offset with respect to the previous stack. As an alternative, the multiple-layer brochures can also be separated by marking strips. In a further alternative, a cross layer can be used for delivery, with the result that the stacks are delivered not only with an offset but also rotated in each case by 90° with respect to one another. All three method variants described advantageously make it possible to simply pick up a collated multiple-layer brochure.

In one advantageous development of the method for collating multiple-layer brochures which are formed from n signatures, every n-th transport segment is occupied with an n-th signature. In other words: all the transport segments are occupied without gaps with in each case one signature.

The invention also relates to a gathering and stitching machine for signatures made from paper, cardboard and the like. The gathering and stitching machine according to the invention has a gathering section with a gathering element and with a plurality m of feeders which are arranged along the gathering section for depositing signatures onto the gathering element, and further has a stitching station, a trimming station and a delivery station. The gathering section, the stitching station, the trimming station and the delivery station are connected to a common control unit. The gathering element of the gathering section has a plurality of transport segments. If the gathering element is formed by a gathering chain, the transport segments are provided by the drivers which are fastened to the gathering chain.

According to the invention, the control unit has a machine program for collating multiple-layer brochures, containing a plurality n of signatures. Here, the machine program actuates the stitching station in such a way that stitching is not carried out, and actuates the trimming station in such a way that cutting is not carried out. The signatures therefore pass the stitching station and the trimming station without being processed, that is to say without being stitched or trimmed. The feeders are actuated by the machine program in such a way that at most one signature is deposited into a respective transport segment.

Here, the number of feeders m is advantageously greater than or equal to the number of signatures n which form a multiple-layer brochure.

A gathering and stitching machine of this type advantageously makes simple and reliable collation of multiple-layer brochures for small runs possible and can thus replace the collation by hand in a simple and inexpensive way.

In one advantageous development of the gathering and stitching machine according to the invention, the delivery station is configured in such a way that a multiple-layer brochure is separated from a respectively following collated multiple-layer brochure. Here, the delivery station can be, in particular, a cross layer. The delivery station can also be a flat web delivery apparatus with marking devices. Both alternatives make it possible in an advantageous way for the machine operator to be able to remove the multiple-layer brochures which are collated by the gathering and stitching machine simply by hand and to be able to feed them to a perfect binder.

In one embodiment of the gathering and stitching machine according to the invention, a respective feeder and/or the stitching station and/or the trimming station and/or the delivery station have/has in each case one control unit. These control units are then connected to the common control unit. In the alternative embodiment of the gathering and stitching machine according to the invention, the actuation takes place exclusively by the common control unit.

Other features which are considered as characteristic for the invention are set forth in the appended claims.

Although the invention is illustrated and described herein as embodied in a gathering and stitching machine and a method for operating the gathering and stitching machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
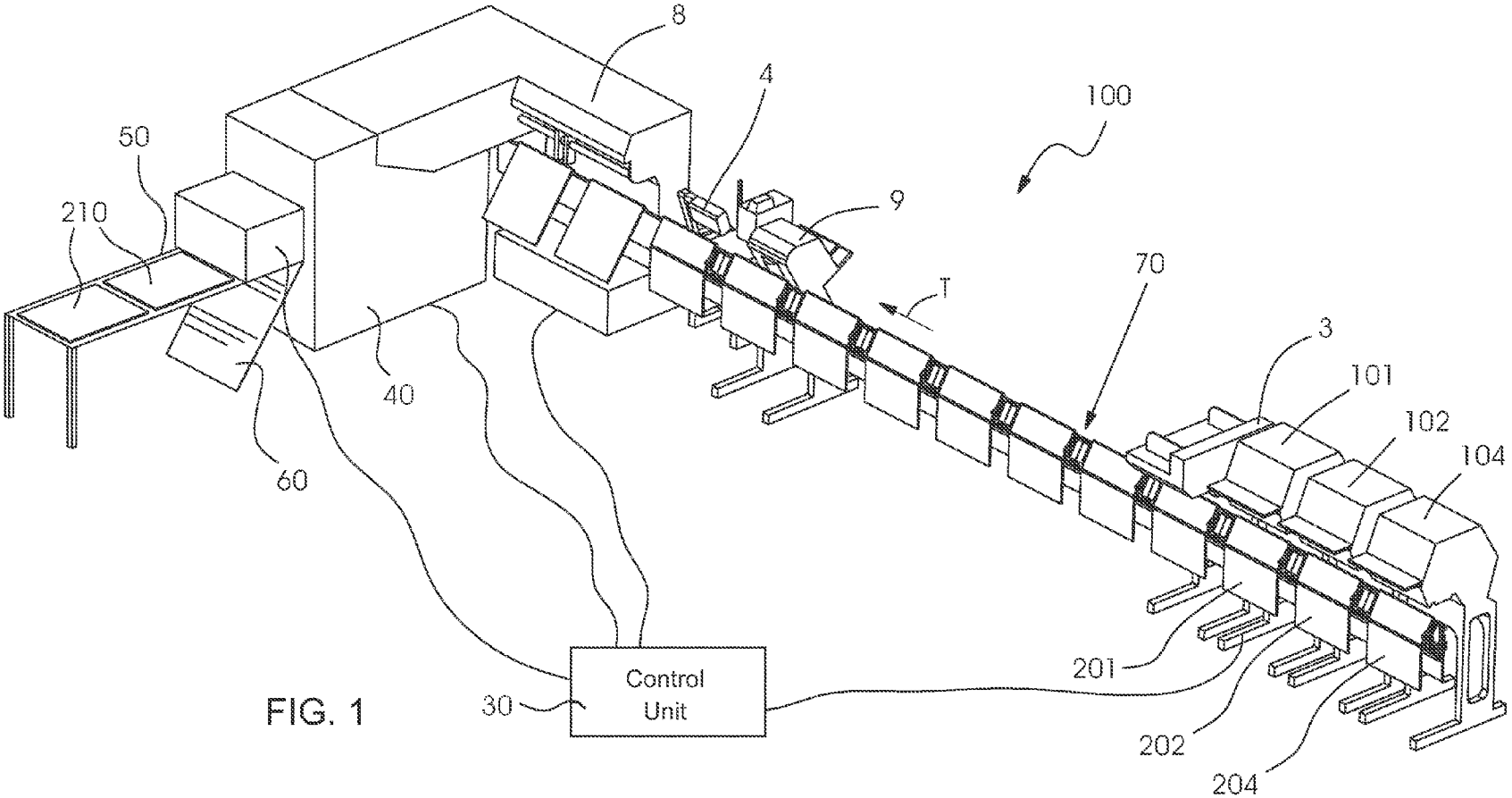
FIG. 1 is a diagrammatic, perspective view of a gathering and stitching machine for collating multiple-layer brochures according to the invention.

Referring now to the figures of the drawing in detail and first, particularly, to FIG. 1 thereof, there is shown a gathering and stitching machine 100 with three feeders 101, 102 and 104, a gathering chain 70, a stitching station 8, a trimming station 40 and a delivery station 50. The feeders 101, 102, 104, a non-illustrated drive of the gathering chain, the stitching station 8, the trimming station 40 and the delivery station 50 are connected to a common control unit 30.

Furthermore, the gathering and stitching machine 100 also has a cover folder feeder 3, a dispensing device 9, an inkjet station 4 and a removing device 60. These components will not be considered in greater detail in the following text, since they are not relevant for the subject matter of the invention and are not used in the application of the method according to the invention. It is only to be clarified here that the gathering and stitching machine 100 is a commercially available gathering and stitching machine.

According to the invention, a machine program which makes collation of multiple-layer brochures 210 possible is stored in the control unit 30. To this end, the stitching station 8 and the trimming station 40 are actuated by the control unit 30 in such a way that they are not operated; in other words, they do not process the signatures 201, 202, 204. The feeders 101, 102, 104 are actuated by the control unit 30 in such a way that they eject signatures 201, 202, 204 in the correct sequence onto the gathering chain 70. The signatures 201, 202, 204 are transported through the stitching station 8 in the transport direction T by the gathering chain 70. Subsequently, the signatures 201, 202, 204 are transported through the trimming station 40 and are delivered as a multiple-layer brochure 210 by the delivery station 50. The operation of collating a respective multiple-layer brochure is evident in greater detail from FIG. 2.

Figure 2:
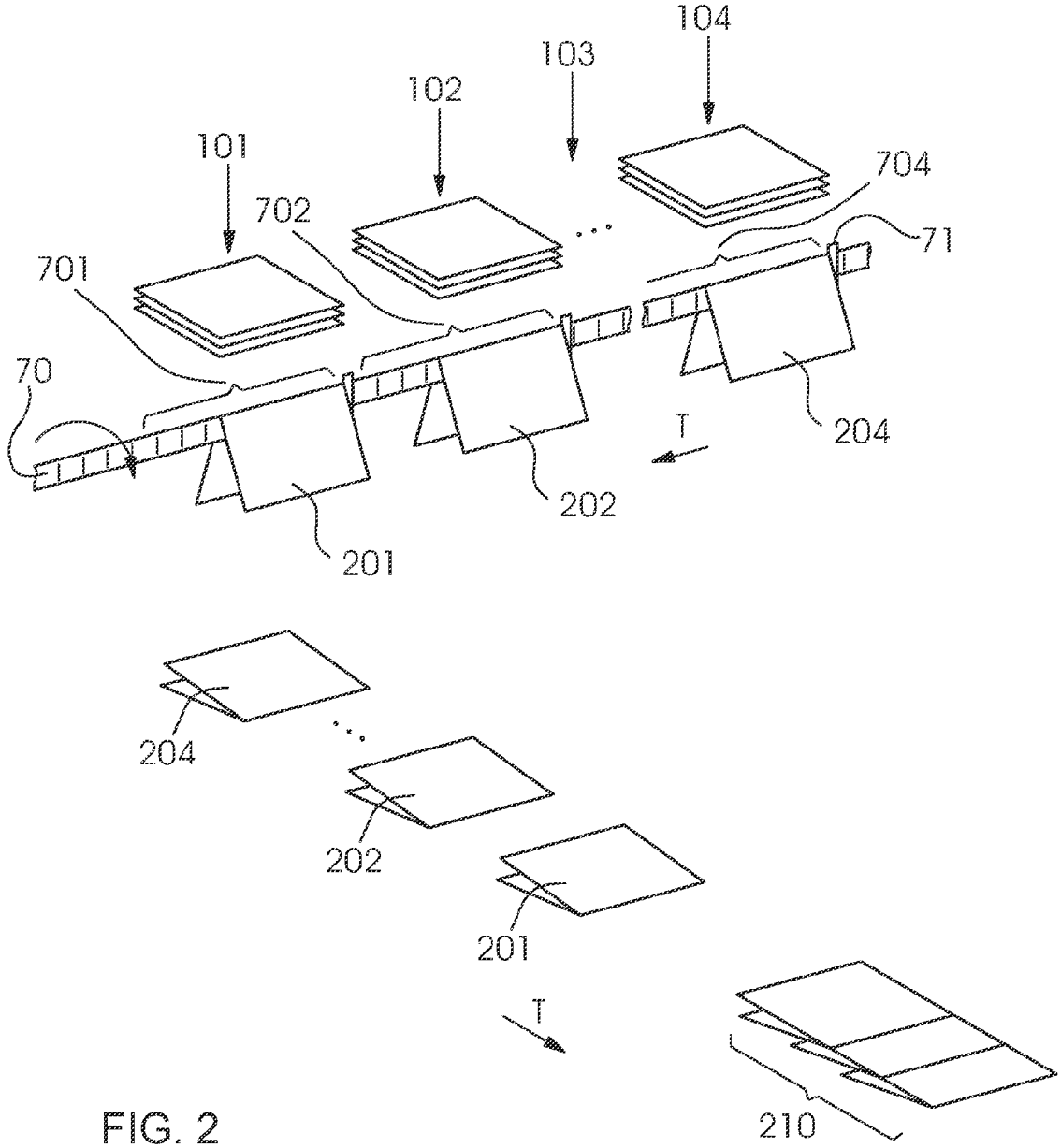
FIG. 2 is a diagrammatic, perspective view for understanding a principle of collation of multiple-layer brochures by the gathering and stitching machine, with the omission of the machine components.

In the illustration of FIG. 2, the gathering element of the gathering and stitching machine 100 is formed by a gathering chain 70. A multiplicity of drivers 71 are fastened to the gathering chain 70, as a result of which transport segments 701, 702, 704 are formed.

A first signature 201 is deposited by a first feeder 101 into the first transport segment 701 of the gathering chain 70. A second signature 202 is deposited by a second feeder 102 into a second transport segment 702. Further feeders which deposit further signatures into further transport segments can be situated at the position 103. Here, the number of feeders m has to correspond to the number of signatures n which form a multiple-layer brochure. In the case which is shown in FIGS. 1 and 2, a multiple-layer brochure 210 is formed by three signatures 201, 202 and 204. n is therefore 3. An n-th signature 204 is deposited by an n-th feeder 104 into an n-th transport segment 704. The signatures 201, 202 and 204 which follow one another, are collated in this sequence and later form a book block are therefore situated on the gathering chain 70. If the signatures 201, 202, 204 are transported in a spaced apart manner at the beginning, they are pushed together or stacked in the region of the delivery station 50 to form a multiple-layer brochure 210 as shown in FIG. 2 below. A multiple-layer brochure 210 which is collated in this way can be removed by the machine operator by hand simply and reliably and can be fed to a perfect binder with manual feeding, as is customary in single tongs binders, for example.

The invetioned claimed:

1. A method for collating multiple-layer brochures having a plurality of n signatures via a gathering and stitching machine, the gathering and stitching machine containing a gathering section having a gathering element being moved by a drive and a plurality of m feeders disposed along the gathering element for depositing the signatures onto the gathering element, a stitching station, a trimming station and a delivery station, the drive of the gathering element and the delivery station being connected to a common control unit, and the gathering element having a plurality of transport segments, which comprises the steps of:

a) depositing a first signature via a first feeder into a first transport segment;

b) depositing a second signature via a second feeder into a second transport segment;

c) correspondingly further depositing of further signatures by further feeders into further transport segments;

d) depositing of an n-th signature by an n-th feeder into an n-th transport segment;

e) transporting of the signatures through the stitching station and the trimming station without stitching or trimming the signatures in the respective stations; and f) delivering and collating the signatures in the delivery station.

2. The method according to claim 1, which further comprises:

g) repeating steps a) to e);

h) delivering the signatures in the delivery station in one stack with an offset with respect to a previous stack; and i) repeating steps g and h.

3. The method according to claim 1, which further comprises, in a case of a multiple-layer brochure having the n signatures, every n-th transport segment is occupied with an n-th signature.

4. A gathering and stitching machine for signatures made from one of paper and cardboard, the gathering and stitching machine comprising:

a gathering section containing a gathering element having a plurality of transport segments and a plurality of m feeders disposed along said gathering element for depositing the signatures onto said gathering element;

a stitching station;

a trimming station;

a delivery station; and a common control unit connected to said gathering section, said stitching station, said trimming station and said delivery station, said common control unit having a machine program for collating multiple-layer brochures containing the plurality of n signatures, said machine program actuating said stitching station such that stitching is not carried out, and actuating said trimming station such that cutting is not carried out, and the signatures pass said stitching station and said trimming station unprocessed, and the machine program actuating said feeders such that at most one signature is deposited into a transport segment.

5. The gathering and stitching machine according to claim 4, wherein a number of said m feeders is greater than or equal to a number of the n signatures.

6. The gathering and stitching machine according to claim 4, wherein said delivery station separates one multiple-layer brochure from a respectively following multiple-layer brochure.

7. The gathering and stitching machine according to claim 4, wherein said delivery station is a cross layer.

8. The gathering and stitching machine according to claim 4, wherein said delivery station is a flat web delivery means with a marking device.

9. The gathering and stitching machine according to claim 4, wherein said common control unit is one of a plurality of control units, at least one of a respective one of said feeders, said stitching station, said trimming station and said delivery station has in each case one of said control units.

10. The gathering and stitching machine according to claim 4, wherein said delivery is configured for collating the signatures.

* * * * *